US006775512B2

(12) United States Patent
Thayer

(10) Patent No.: US 6,775,512 B2
(45) Date of Patent: Aug. 10, 2004

(54) DUAL ELECTROSTATIC BRUSH CLEANER BIAS SWITCHING FOR MULTIPLE PASS CLEANING OF HIGH DENSITY TONER INPUTS

(75) Inventor: Bruce E. Thayer, Webster, NY (US)

(73) Assignee: Xerox Corporation, Stamford, CT (US)

( * ) Notice: Subject to any disclaimer, the term of this patent is extended or adjusted under 35 U.S.C. 154(b) by 54 days.

(21) Appl. No.: 10/252,901

(22) Filed: Sep. 23, 2002

(65) Prior Publication Data

US 2004/0057762 A1 Mar. 25, 2004

(51) Int. Cl.[7] ..... G03G 21/00
(52) U.S. Cl. ..... 399/353; 399/354
(58) Field of Search ..... 399/353, 354; 15/256.5, 256.51, 256.52

(56) References Cited

U.S. PATENT DOCUMENTS 4,545,669 A 10/1985 Hays et al.
4,599,285 A 7/1986 Haneda et al. ..... 430/54
4,679,929 A 7/1987 Haneda et al.
5,233,398 A * 8/1993 Nimura et al. ..... 399/354
5,257,079 A 10/1993 Lange et al.
5,623,721 A * 4/1997 Lindblad et al. ..... 399/354
5,655,204 A * 8/1997 Siegel ..... 399/354 X
5,729,815 A 3/1998 Lindblad et al. ..... 399/354
5,771,424 A * 6/1998 Lindblad et al. ..... 399/354 X
5,903,797 A * 5/1999 Daniels et al. ..... 399/71 X

* cited by examiner

*Primary Examiner*—William J. Royer
(74) *Attorney, Agent, or Firm*—Lloyd F. Bean, II

(57) ABSTRACT

An apparatus for removing charged particles from a surface, the surface being capable of movement, including: a preclean corotron having a first polarity; and a first cleaning brush for cleaning charged particles from the surface, having a second polarity different from the first polarity of the preclean corotron; a second cleaning brush for cleaning the charged particles from the surface, having a predefined polarity, the second cleaning brush being located downstream from the first cleaning brush, in the direction of motion of the surface; and a controller for changing the predefined polarity of the second cleaning brush from the first polarity to the second polarity.

16 Claims, 3 Drawing Sheets

DUAL ELECTROSTATIC BRUSH CLEANER BIAS SWITCHING FOR MULTIPLE PASS CLEANING OF HIGH DENSITY TONER INPUTS

This invention relates to an electrostatographic printer or copier, and more particularly concerns a cleaning apparatus for removing toner from an imaging surface.

Electrostatic brush (ESB) cleaners are designed to satisfy a requirement of cleaning a maximum toner mass entering the cleaner in a given number of passes through the cleaner. Generally these requirements are a maximum single pass cleaning requirement and a maximum two pass cleaning requirement. The single pass cleaning requirement is typically a residual toner mass on a photoreceptor belt following transfer under conditions of the highest developed mass (DMA) with the lowest transfer efficiency (TE). In some machines a mark-to-edge, or bleed edge, requirement raises the single pass cleaning requirement to the highest DMA level. The two pass cleaning requirement is typically cleaning of untransferred control patches and/or untransferred images in jam recovery. These input densities are equal to the highest DMA. It has been demonstrated that a two pass cleaning requirement is equivalent to cleaning half of the required toner mass in a single pass.

The two pass cleaning requirement, except in the case of mark-to-edge machines, is much more stressful than the single pass cleaning requirement. Therefore, the cleaning brushes are designed to clean the two pass requirement. Half of the toner is cleaned in each pass through the cleaner. In designing the cleaner the speed of the brushes, the number of fibers on the brushes, the interference of the brushes to the photoreceptor belt, the electrical bias on the brushes and the number of brushes are chosen to clean the equivalent single pass toner input.

Conventional multiple electrostatic brush cleaners consist of two or more brushes electrically biased to remove toner and other debris from the photoreceptor surface of the photoreceptor belt. Prior to the brushes a preclean charge device adjusts the toner charge of the incoming toner to a natural tribo charging polarity of the toner. This is known as right sign toner. Toner that does not charge to the polarity of the majority of the toner in the preclean charging step is known as wrong sign toner. The first brushes are biased opposite to the polarity of the right sign toner so that this toner can be removed. The last cleaning brush is biased opposite to the first brushes so that the wrong sign toner can be removed. Since there is only a small percentage of the toner that is wrong sign only a single brush is ever needed to clean the wrong sign toner mass.

Conventional multiple electrostatic brush cleaners have their single pass toner cleaning capacity limited by the amount of right sign toner that can be cleaned by the first brushes and the amount of wrong sign toner that can be cleaned by the last brush. As more cleaning capacity is required, such as for an increase in machine process speed, additional right sign cleaning brushes or additional cleaning passes must be added. These additions to the cleaning system are undesirable. Additional cleaning brushes increase the size and cost of the cleaner and may not fit in the available machine space. Additional cleaning passes decrease the productivity of the machine by requiring a longer recovery from paper jams. Additional cleaning passes impact the xerographic control of the machine by requiring a longer time to clean process control patches.

The following disclosures may be relevant to various aspects of the present invention and may be briefly summarized as follows:

U.S. Pat. No. 5,729,815 to Lindblad et al. discloses an apparatus and method for cleaning charged triboelectric negative toner residual particles from a photoreceptor surface. A positive bias is applied to two electrostatic brushes in a dual cleaning system or to a single electrostatic brush. The rotational speed of the single electrostatic brush is increased, over that of the individual brushes in a dual brush cleaner, to clean charged triboelectric negative toner particles.

U.S. Pat. No. 5,257,079 to Lange et al. discloses a cleaning brush electrically biased with an alternating current to remove discharged particles from an imaging surface. The particles on the imaging surface are discharged by a corona generating device. A second cleaning device including an insulative brush, a conductive brush or a blade, located upstream of the first mentioned brush, in the direction of movement of the imaging surface, further removes redeposited particles therefrom.

U.S. Pat. No. 4,545,669 to Hays et al. discloses an apparatus for simultaneously charging, exposing, and developing imaging members at low voltages which comprises a semi-transparent deflected flexible imaging member, an electronic imaging source means, a light beam deflector member, a means containing magnets therein, a development roll means containing magnets therein, a voltage source means for sensitizing roll means, a voltage source for the development roll means, a developer supply reservoir containing conductive developer particles therein comprised of insulating toner resin particles and conductive carrier particles, a sensitizing nip situated between the flexible imaging member and the sensitizing roll means, a development nip situated between the flexible imaging member and the development roll means, the sensitizing roll means and development roll means moving in the same direction of movement as the semitransparent deflected flexible imaging member, the voltage being generated by the voltage source means with the sensitizing nip being of an opposite polarity of the voltage generated by the voltage source means for the development roll means, wherein an electric field of a predetermined polarity is established between the semi-transparent deflected flexible imaging member and the sensitizing roll means, which field exerts in the sensitizing nip an electrostatic force on the charged toner particles causing these particles to uniformly migrate toward the flexible imaging member, subsequently subjecting the deflected flexible imaging member to the electronic imaging source means whereby the electrostatic force exerted on the toner particles adjacent the light struck areas of the flexible imaging member are increased thereby causing toner particles to be deposited on the deflected flexible imaging member, and wherein toner particles are removed from the deflected flexible imaging member in areas not exposed to light by the development roll means and developed in the areas exposed to light.

Briefly stated, and in accordance with one aspect of the present invention, there is provided a multiple electrostatic brush cleaner the first brushes are biased to clean right sign toner and the last brush is biased to clean wrong sign toner. The highest cleaning stress occurs when untransferred toner is cleaned following a machine jam or control patches are cleaned. Generally two or more passes are allowed to clean these very high density inputs to the cleaner. The present invention biases all brushes for the first cleaning pass to clean right sign toner. On the second cleaning pass the brushes are biased normally. This new bias switching arrangement results in more efficient use of the cleaning brushes and allows existing cleaners to be used at higher process speeds than with conventional multi-pass cleaner biasing. Bias switching is especially advantaged with air detoning of the electrostatic brush cleaner since little toner accumulates in the brushes. Since there are opportunities for any toner redeveloped to a photoreceptor during the bias switching to be cleaned in the following passes, switching may also be useful in electrostatically detoned cleaners.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted-for use in a color electrostatographic printing or copying machine, it should become evident from the following discussion, that it is equally well suited for use in a wide variety of devices and is not necessarily limited to the particular embodiments shown herein.

Figure 3:
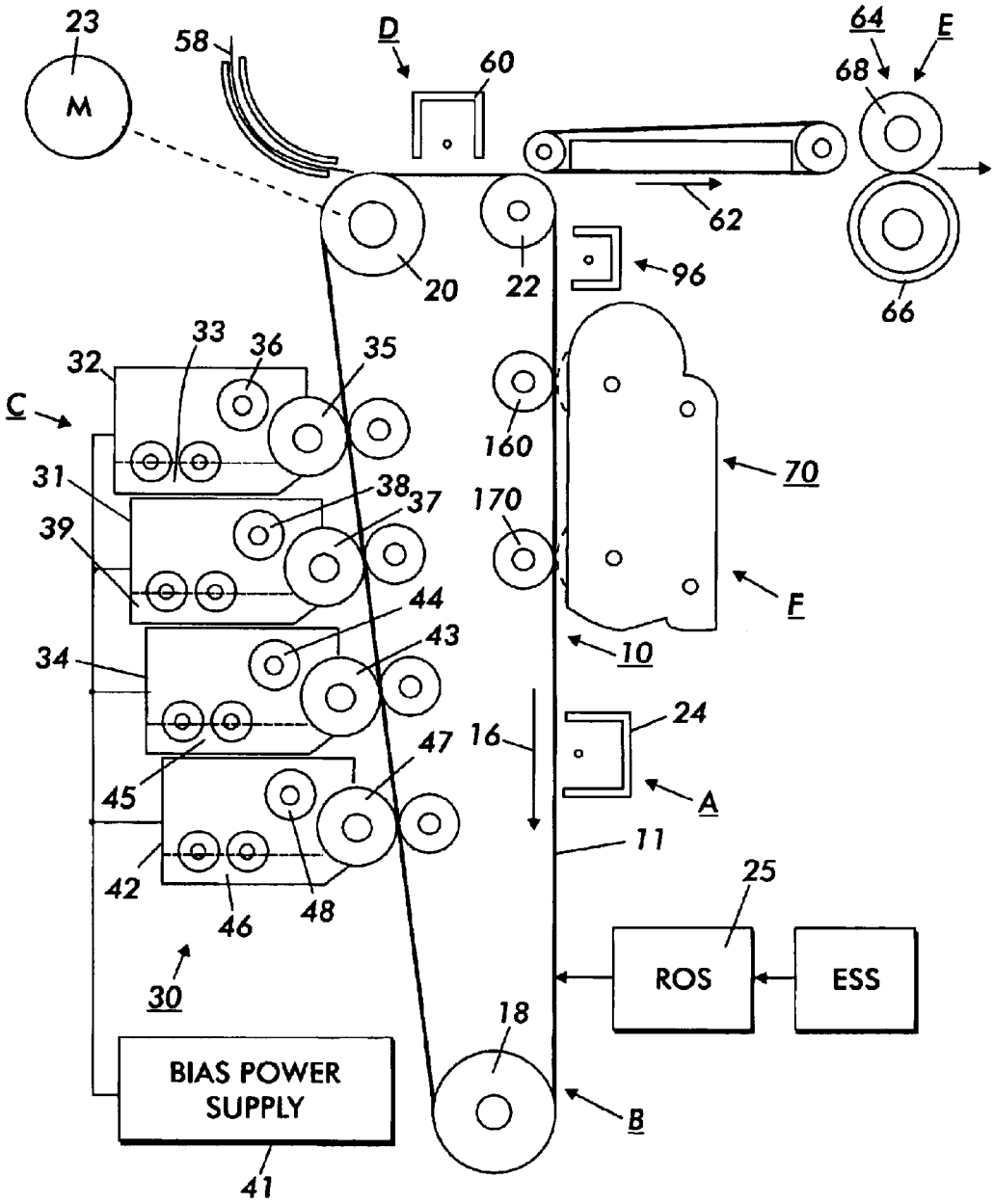
FIG. 3 is a schematic illustration of a printing apparatus incorporating the inventive features of the present invention.

Referring now to the drawings, where the showings are for the purpose of describing a preferred embodiment of the invention and not for limiting the same, the various processing stations employed in the reproduction machine illustrated in FIG. 3 will be briefly described.

A reproduction machine, from which the present invention finds advantageous use, utilizes a charge retentive member in the form of a photoconductive belt 10 consisting of a photoconductive surface 11 and an electrically conductive, light transmissive substrate mounted for movement pass charging station A, and exposure station B, developer station C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the belt 10. A motor 23 rotates roller 20 to advance belt 10 in the direction of arrow 16. Roller 20 is coupled to motor 23 by suitable means such as a belt drive.

As can be seen by further reference to FIG. 3, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoconductive surface 11 are advanced through exposure station B. At exposure station B, the uniformly charged, photoconductive belt, photoreceptor or charge retentive surface 10 is exposed to a laser based input and/or output scanning device 25 which causes the charge retentive surface 10 to be discharged in accordance with the output from the scanning device 30 (for example a two level Raster Output Scanner (ROS)).

The photoreceptor 10, which is initially charged to a voltage, undergoes dark decay to a voltage level. When exposed at the exposure station B it is discharged to near zero or ground potential for the image area in all colors.

The system shown is a multiple pass—single transfer system. The cleaner is retracted for the development of each color, 4 passes in the shown configuration. After the final color is developed, the four layer image is transferred to paper and the cleaner cammed in to remove any transfer residual toner. The description of the process implies that all colors are developed following a single charge and exposure step.

At development station C, a development system, indicated generally by the reference numeral 30, advances development materials into contact with the electrostatic latent images. The development system 30 comprises first 42, second 34, third 31 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 34 comprises a housing containing a donor roll 43, a magnetic roller 44, and developer material 45. The third developer apparatus 31 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the photoconductive or imaging surface 11. It is noted that development housings 32, 34, 39, 42, and any subsequent development housings must be scavengeless so as not to disturb the image formed by the previous development apparatus. All four housings contain developer material 33, 39, 45, 46 of selected colors. Electrical biasing is accomplished via bias sower supply 41, electrically connected to developer apparatuses 32, 34,39 and 42.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, and removal from the machine by the operator. Alternatively, the sheet may be advanced to a duplex tray (not shown) from which it will be returned to the processor for receiving a second side copy. A leading edge to trailing edge reversal and an odd number of sheet inversions is generally required for presentation of the second side for copying. However, if overlay information in the form of additional or second color information is desirable on the first side of the sheet, no leading edge to trailing edge reversal is required. Of course, the return of the sheets for duplex or overlay copying may also be accomplished manually. Residual toner and debris remaining on photoreceptor 10 after each copy is made, may be removed at cleaning station F with a brush or other type of cleaning system 70, after the particles are charged a preclean corotron 96. The cleaning system 70 is supported under the photo receptor 10 by two backers 160 and 170.

Figure 1:
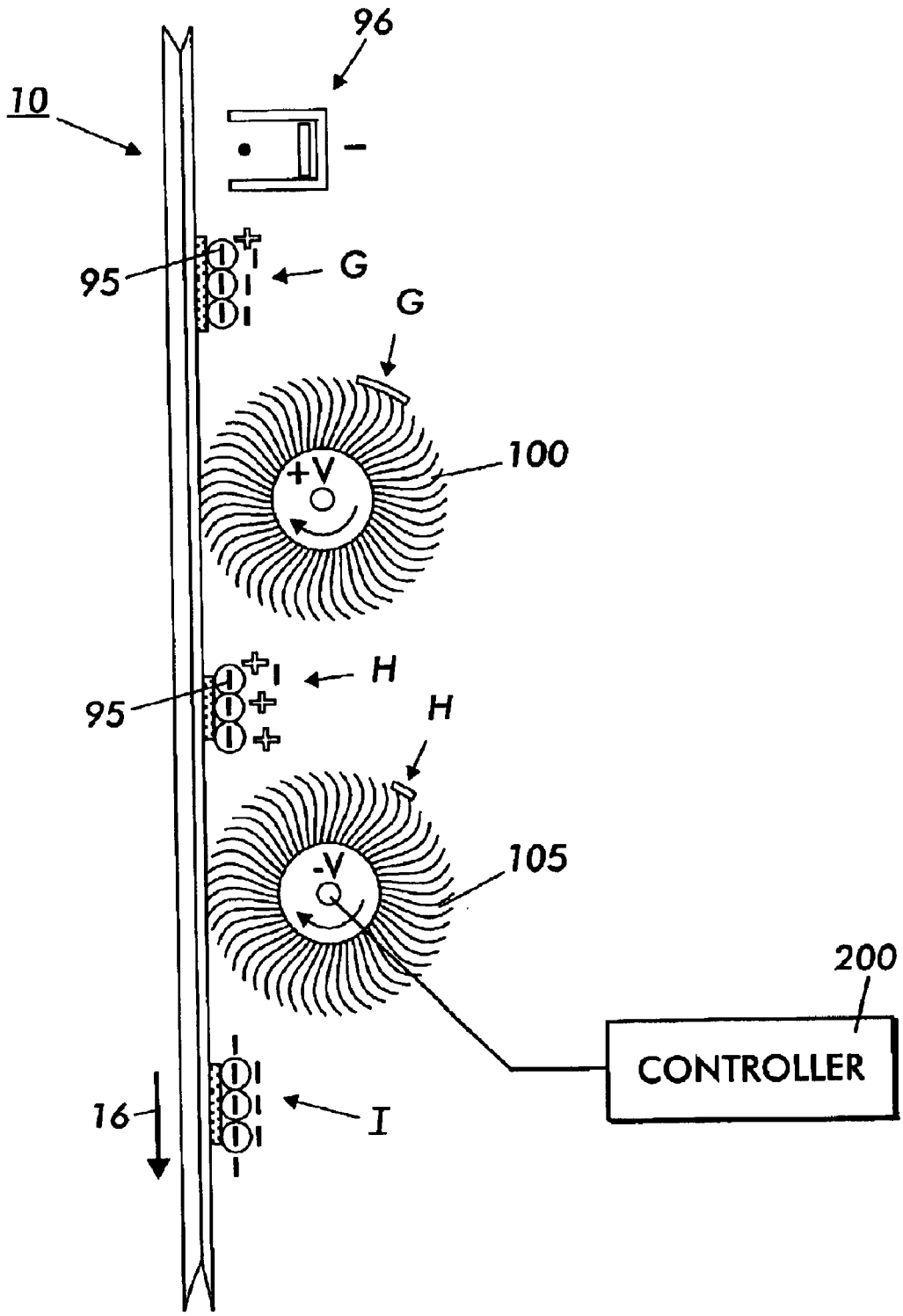
FIG. 1 is a schematic illustration of a first mode of operation of the present invention using a positively biased first brush and a negatively biased second brush.

Reference is now made to FIG. 1, which shows the conventional brush bias polarity for a DESB (i.e., dual electrostatic brush) cleaner to remove residual triboelectric negative toner particles from an imaging surface. A negative preclean corotron 96 provides negative charge to the residual triboelectric negative toner particles 95 remaining on the photoreceptor 10 (e.g. imaging surface) after transfer. A residual toner particle patch or toner patch G carries predominantly a high negative charge after preclean (although a small amount of low positive charge is present). The triboelectric negative toner particles 95 accept negative charge from the negative preclean corotron 96. This is an inherent toner characteristic that allows the triboelectric negative toner particles 95 to have a high negative charge value in the toner patch G. Thus, first cleaner brush 100, rotating against the direction of motion (shown by arrow 16) of the photoreceptor 10, is positively biased to attract the predominantly negatively charged toner particles G from the photoreceptor 10. With typical post transfer residual toner input the positively biased first cleaner brush 100 removes almost all of the negatively charged toner in toner patch G that is later detoned from the first cleaner brush 100. However, a small portion of the toner patch G is often not cleaned by the first cleaner brush 100, (i.e. a small portion passes under the first cleaner brush 100 and a small amount may be redeposited from the first cleaner brush 100 onto the photoreceptor 10) and remains on the photoreceptor 10, after the first cleaner brush 100, as a toner patch H. For typical post transfer residual toner input the toner patch H of triboelectric toner 95 is predominantly positively charged after contact with the positively biased first cleaner brush 100 and of very low density. For high density inputs, such as experienced during jam recovery, control patch cleaning and other cases, toner patch G may not be substantially cleaned by the first cleaner brush 100. In this case toner patch H will consist largely of negatively charged toner particles at a relatively high density.

With continuing reference to FIG. 1, the second cleaner brush 105, rotating against the direction of motion (shown by arrow 16) of the photoreceptor 10, is negatively biased. For the typical post transfer residual toner input case toner patch H is cleaned by the second cleaner brush 105, due to the positive charge on the toner, the low toner density of the patch and the negative bias of the second cleaner brush 105. In this case a residual toner patch I following the second cleaner brush 105 is typically less than 30 toner particles per $mm^2$. For the high input density case (e.g., jam recovery) toner patch H is poorly cleaned by the second cleaner brush 105, due to the negative charge on the toner, the relatively high toner density of the patch and the negative bias of the second cleaner brush 105. For this case the residual toner patch I following the second cleaner brush 105 is nearly as high a density as the toner patch H entering the second cleaner brush 105. A second cleaning pass through the conventionally biased DESB shown in FIG. 1 will remove substantially the same quantity of toner from the photoreceptor 10 as was removed during the first cleaning pass. More than two cleaning passes may be required to remove very high toner input densities. More than two cleaning passes is generally undesirable due to a decrease in machine productivity for paper jam recovery and a longer time between process control patch readings.

Figure 2:
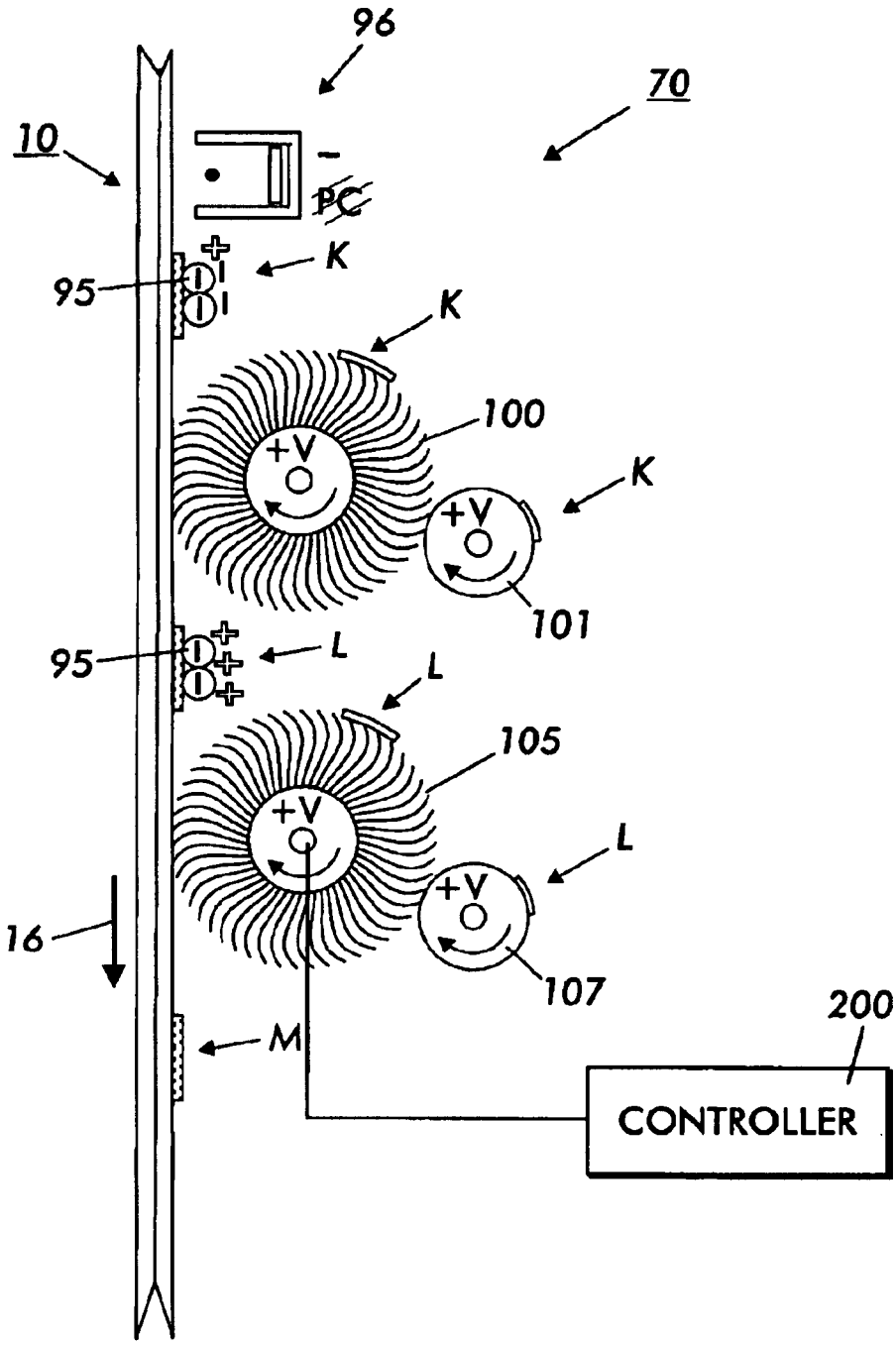
FIG. 2 is a schematic illustration of a second mode of operation of the present invention using all positively biased brushes.

Reference is now made to FIG. 2, which shows the preferred embodiment for the first of two cleaning passes of the present invention using dual electrostatic cleaner brushes for cleaning high toner density inputs to a cleaner. These high input densities are greater than the toner density that can be cleaned in two passes through a conventionally biased cleaner. The residual toner patch K of high density charged triboelectric negative toner particles 95 is negatively charged by a negative preclean corotron 96. The first cleaner brush 100, rotating against the direction of motion, shown by arrow 16, of the photoreceptor 10, is positively biased to remove negatively charged toner particles 95 in residual patch K from the photoreceptor 10. Toner cleaned from toner patch K is detoned from the first cleaner brush 100 by a detoning roll 101. (Other means of detoning not shown include air detoning and flicker bars.) The toner particles not removed by the first positively biased cleaner brush 100, on the photoreceptor 10, are shown by toner patch L. The second cleaner brush 105 rotating against the direction of motion of the photoreceptor 10, shown by arrow 16, is also positively biased. The second positively biased cleaner brush 105 removes toner particles from toner patch L from the photoreceptor 10. The toner cleaned from toner patch L is then removed from the second cleaner brush 105 by a detoning roll 107. The toner particles not removed by the second positively biased cleaner brush 105, on the photoreceptor 10, are shown by toner patch M.

In the second pass of the two pass cleaning process the brush biases revert to the conventional polarities by controller 200 as shown in FIG. 1. A negative preclean corotron 96 provides negative charge to the triboelectric negative toner particles 95 in toner patch M that were not cleaned from the photoreceptor 10 (e.g. imaging surface) in the first cleaning pass. The toner patch G carries predominantly a high negative charge after preclean (although a small amount of low positive charge is present). The first cleaner brush 100, rotating against the direction of motion (shown by arrow 16) of the photoreceptor 10, is positively biased to attract the predominantly negatively charged toner particles from the photoreceptor 10. Because the toner input density to the positively biased first cleaner brush 100 has been reduced by a prior cleaning pass under both brushes biased positively almost all of the negatively charged toner in toner patch G is cleaned and later detoned from the first cleaner brush 100. However, a small portion of wrong sign toner in the toner patch G is often not cleaned by the first cleaner brush 100, (i.e. a small portion passes under the first cleaner brush 100 and a small amount may be redeposited from the first cleaner brush 100 onto the photoreceptor 10) and remains on the photoreceptor 10, after the first brush 100, as a toner patch H. Because of three cleaning passes under positively biased brushes the toner density of toner patch H is very low.

With continuing reference to FIG. 1, the second cleaner brush 105, rotating against the direction of motion (shown by arrow 16) of the photoreceptor 10, is negatively biased. Toner patch H is cleaned by the second cleaner brush 105, due to the positive charge on the toner, the low toner density of the patch and the negative bias of the second cleaner brush 105. The residual toner patch I following the second cleaner brush 105 is typically less than 30 toner particles per $mm^2$.

It is, therefore, apparent that there has been provided in accordance with the present invention, bias switching of dual electrostatic brushes with a negative preclean corotron for negatively charged triboelectric toner that fully satisfies the aims and advantages hereinbefore set forth. While this, invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing charged particles from a surface, the surface being capable of movement, comprising:

a preclean corotron having a first polarity; and a first means for cleaning the charged particles from the surface, having a second polarity different from said first polarity of said preclean corotron;

a second means for cleaning the charged particles from the surface, having a predefined polarity, said second cleaning means being located downstream from said first cleaning means, in the direction of motion of the surface; and a controller for changing the predefined polarity of said second cleaning means from said first polarity to said second polarity.

2. An apparatus as recited in claim 1, wherein during a first pass of a multiple pass cleaning process of a portion of the surface, said first cleaning means and said second cleaning means have the same polarity.

3. An apparatus as recited in claim 2, wherein during a second pass of a multiple pass cleaning process of the portion of the surface, said first cleaning means and said second cleaning means have the opposite polarity.

4. An apparatus as recited in claim 2, wherein during the last pass of a multiple pass cleaning process of the portion of the surface, said first cleaning means and said second cleaning means have the opposite polarity.

5. An apparatus as recited in claim 1, wherein said first cleaning means comprises a first brush.

6. An apparatus as recited in claim 5, wherein said first brush is conductive.

7. An apparatus as recited in claim 6, wherein said first polarity comprises a negative charge.

8. An apparatus as recited in claim 7, wherein said second cleaning means comprises a second brush.

9. An apparatus as recited in claim 8, wherein said second brush is conductive.

10. An apparatus as recited in claim 8, wherein said first brush and said second brush, both being positively biased, contact the surface to remove the charged particles therefrom during a first pass of a multiple pass cleaning process.

11. An apparatus as recited in claim 8, wherein said second brush, being positively charged, removes the charged particles having predominantly positive charge from the surface.

12. An apparatus as recited in claim 11, wherein said second brush, being negatively charged during second pass of a multiple pass cleaning process, removes the charged particles having predominantly positive charge from the surface.

13. An apparatus as recited in claim 5, further comprising:

a housing for holding said first cleaning means and said second cleaning means being partially enclosed therein.

14. An apparatus as recited in claim 13, wherein said second polarity comprises a positive charge.

15. An apparatus as recited in claim 5, wherein said first brush being positively charged, removes the charged particles having predominantly negative charge from the surface.

16. A method for cleaning charged triboelectric negative particles from a moving surface, comprising:

transferring an image to a print medium;

precleaning the charged triboelectric negative particles remaining after transfer, on the moving surface, using a negatively charged corotron;

charging a first brush positively to remove both the charged triboelectric negative particles having negative charge and the charged triboelectric negative particles having positive charge that remain on the moving surface after transfer as the first brush contacts the moving surface; and charging, during a first pass of a multiple pass cleaning process of a portion of the moving surface, a second brush positively, located downstream from the first brush in a direction of motion of the moving surface, to remove both the charged triboelectric negative particles having negative charge and the charged triboelectric negative particles having positive charge that remain on the moving surface after transfer as the second brush contacts the moving surface; and charging, during the second pass of a multiple pass cleaning process of the portion of the moving surface, a second brush negatively.

* * * * *